US006419600B1

(12) United States Patent
York et al.

(10) Patent No.: US 6,419,600 B1
(45) Date of Patent: Jul. 16, 2002

(54) GOLF BALL HANDLING APPARATUS

(75) Inventors: Michael T. York, Walled Lake; Steven J. Yockey, Ypsilanti, both of MI (US)

(73) Assignee: Morris Rosen bloom & Co., Inc., Macedon, NY (US)

( * ) Notice: Subject to any disclaimer, the term of this patent is extended or adjusted under 35 U.S.C. 154(b) by 0 days.

(21) Appl. No.: 09/637,128

(22) Filed: Aug. 11, 2000

(51) Int. Cl.[7] ..... A63B 47/02; A63B 49/00; A63B 59/00; A63B 59/18

(52) U.S. Cl. ..... 473/517; 294/19.2

(58) Field of Search ..... D21/722, 796; 473/132, 133, 134, 135, 136, 517; 294/19.2

(56) References Cited

U.S. PATENT DOCUMENTS 2,962,321 A * 11/1960 Fowler et al. ..... 294/19.2
4,063,769 A * 12/1977 Zimmer ..... 294/19 A
4,177,996 A * 12/1979 Chang ..... 273/201
4,676,397 A 6/1987 Hoffmeister
5,147,101 A 9/1992 Tiller
5,395,146 A * 3/1995 Liu et al. ..... 294/19.2
5,639,133 A 6/1997 Mote
5,975,600 A 11/1999 Hwang
5,988,716 A 11/1999 Liao

* cited by examiner

*Primary Examiner*—Paul T. Sewell
*Assistant Examiner*—Alvin A. Hunter, Jr.
(74) *Attorney, Agent, or Firm*—Neal L. Slifkin; Harris Beach LLP

(57) ABSTRACT

A golf ball handling apparatus comprises a hollow body for holding a plurality of golf balls, a passage between the body and the end of the apparatus, a ball control mechanism, a ball guide and legs for elevating one side of the body. The ball control mechanism includes a biased lever pivotally attached to the passage. A stop extends from the bottom of the lever into the passage and is moveable between an open and closed position as the lever is depressed and released. The lever is biased so that the stop is normally closed. Balls are retrieved from the playing surface by pressing the end of the device over the ball, forcing the ball into the passage. The ball moves the stop out of the way as it travels into the passage. In the closed position the stop partially blocks the passage in the body preventing balls from exiting. To dispense balls the lever is depressed, moving the stop to an open position allowing a golf ball to roll out of the passage onto the playing surface.

21 Claims, 6 Drawing Sheets

GOLF BALL HANDLING APPARATUS

BACKGROUND—Field of Invention

The present invention relates to an apparatus to aid a golfer in retrieving a plurality of golf balls from a playing surface and storing them within the apparatus. Additionally, the device can be used to dispense the balls individually.

BACKGROUND—Description of Related Art

Golfing is an extremely popular sport for all ages and is enjoyed worldwide. The sport is often started early in life and is continued until the player is no longer able to physically play the game.

It is critical to the sport for the player to develop consistent playing methods in order to improve his or her game. Players at all skill levels practice refining their techniques to ensure repeatability and to allow them to focus on a specific area they are working on. Generally, a player will practice hitting using a large number of balls in order to allow him or her to concentrate on a certain shot or club without having to retrieve the ball after each shot. However, there is considerable difficulty using a large number of balls to practice if the player does not have a device to help him or her handle the balls.

There have been a number of devices developed to help facilitate practicing with a large number of balls. They aid the player by reducing the time it takes to retrieve the balls and to provide a storage mechanism in which the balls can be removed for play. One of these devices is the Golf Ball Pick-Up Device, U.S. Pat. No. 5,395,146. This device will retrieve and dispense golf balls during practice. However, as clearly seen by the detailed description in this patent, it is a complicated device, requiring a significant number of parts that have to be manufactured and assembled. Therefore, the product is expensive to manufacture and complicated to use. Additionally, due to the relatively expensive design the cost is prohibitive for some golfers.

There have been a number of other attempts to resolve this issue using a design that includes a pickup tube with a storage bag attached to the end as shown on the Golf Ball Pickup U.S. Pat. No. 5,988,716. The storage bag on these devices typically has a zipper to escape the balls after they have been retrieved using grippers on the end of the tube. The problem with this device is that it is not easy to escape one ball at a time and, therefore, the user generally dumps the balls on the ground through the open zipper and cannot control the number of balls dispensed. If the player only wants one ball at a time, he or she is forced to unzip the bag, grab a ball and rezip the bag to prevent the other balls from coming out. Generally, these types of designs do not have legs in order to stand them up and, therefore, require the user to bend over to retrieve a ball from the storage bag.

Another apparatus that has been developed for this use is the Ergonomic Ball Retriever and Dispenser, U.S. Pat. No. 5,639,133. This device allows the user to retrieve a plurality of balls, store them within a body and access the storage area from an opening at the top of the device. However, as can be seen in the patent drawings of this device, in order for the user to use one ball at a time he or she must reach down into the storage unit and retrieve the ball by hand. This action interrupts the player's practice and breaks his or her concentration resulting in a less productive practice session.

An additional apparatus that has been previously developed is the Golf Ball Dispensing and Retrieving System U.S. Pat. No. 5,147,101. This device will retrieve and dispense golf balls. However, as can be seen by the detailed description and related figures in this patent, the ball control method, referred to as the trigger, lever, stop and detent assembly in the patent, partially extends beyond the tubular body. This protruding portion is called the detent 30 and can be seen in FIG. 5A in the patent. The detent is critical to the design in this device and cannot be eliminated because it can't pickup a ball if the ball control assembly is moved into the tub. In this invention, the center of the ball must travel past the tip of the abutment 38 before the tube contacts the ground. It can be easily seen that this protruding section would damage delicate playing surfaces of a golf course when it is forced over a ball while attempting to retrieve the ball into the tube. Once the center of the ball moves past the tip abutment, the tendency of the device is to accelerate toward the ground because the user is applying a downward force. Therefore, the detent hits the ground relatively hard, leaving a damaged area. This makes the product significantly less desirable for use on golf course putting greens because they have delicate soft surfaces. Additionally, because the detent extends well beyond the end of the tube, as shown in the referred to patent FIG. 5G, it is susceptible to damage during use. As can be seen in this figure, if the user forces the device over the ball hard, the detent will contact the ground and possibly bend or break. The extended detent would also make it difficult or impossible to retrieve golf balls from the bottom of putting cups because the bottom of putting cups are generally tapered downward allowing the ball to rest down in the middle. Therefore, the bottom of the cup does not have the clearance room needed for the detent to function correctly. The device also requires a long slanted front base referred to as front face 36 in the referenced patent. This face serves to rotate the lever to the open position while it is being forced over a ball. This slanted front face requires the detent to be longer than desirable, extending significantly beyond the end of the tube. This extended detent can be awkward to handle and may snag on clothing or possibly cause injury while carrying the device. Another disadvantage of this device is that it uses a strap on the outside of the tube to mount the ball control mechanism. It can be seen that the strap is exposed all the way around the tube and could be damaged or slid up or down the tube during use moving the entire assembly out of position.

Therefore, a simple, inexpensive and easy-to-use device that will allow a player to retrieve a plurality of balls, store them within a body and dispense them one at a time as needed during practice is desired and would serve to make practicing more productive and enjoyable. A device is also needed which will permit retrieval and dispensing of balls without damaging the playing surface.

SUMMARY OF THE INVENTION

Accordingly, several objects and advantages of the present invention are:

(a) to provide a golf ball retrieving, storing and dispensing device that does not require the player to use his or her hand to remove balls from storage;

(b) to provide a golf ball retrieving, storing and dispensing device that can be used without damaging delicate playing surfaces such as golf course putting greens;

(c) to provide a golf ball retrieving, storing and dispensing device that will store a plurality of balls and allow the player to dispense one ball at a time using the end of his or her golf club to activate the dispensing mechanism;

(d) to provide a golf ball retrieving, storing and dispensing device that is inexpensive and simple to manufacture;

(e) to provide a golf ball retrieving, storing and dispensing device that is light weight and simple to use;

(f) to provide a golf ball retrieving, storing and dispensing device that is robustly designed for reliable use; and (g) to provide a golf ball retrieving, storing and dispensing device that is aesthetically pleasing to the eye making it an attractive part of the player's golfing equipment;

Further objects and advantages of the present invention will become apparent from a consideration of the drawings and ensuing description.

In accordance with the present invention, a golf ball retrieving, storing and dispensing device, comprising a plastic molded body with attached legs, lever and ball guide. The body consists of a handle for carrying, a hollow interior for ball storage, and an opening at one end to allow balls to enter or exit. The opening for allowing the balls to enter and exit is sized to accommodate golf balls having a larger diameter than the standard size.

DRAWING FIGURES

DESCRIPTION OF INVENTION

Figure 1:
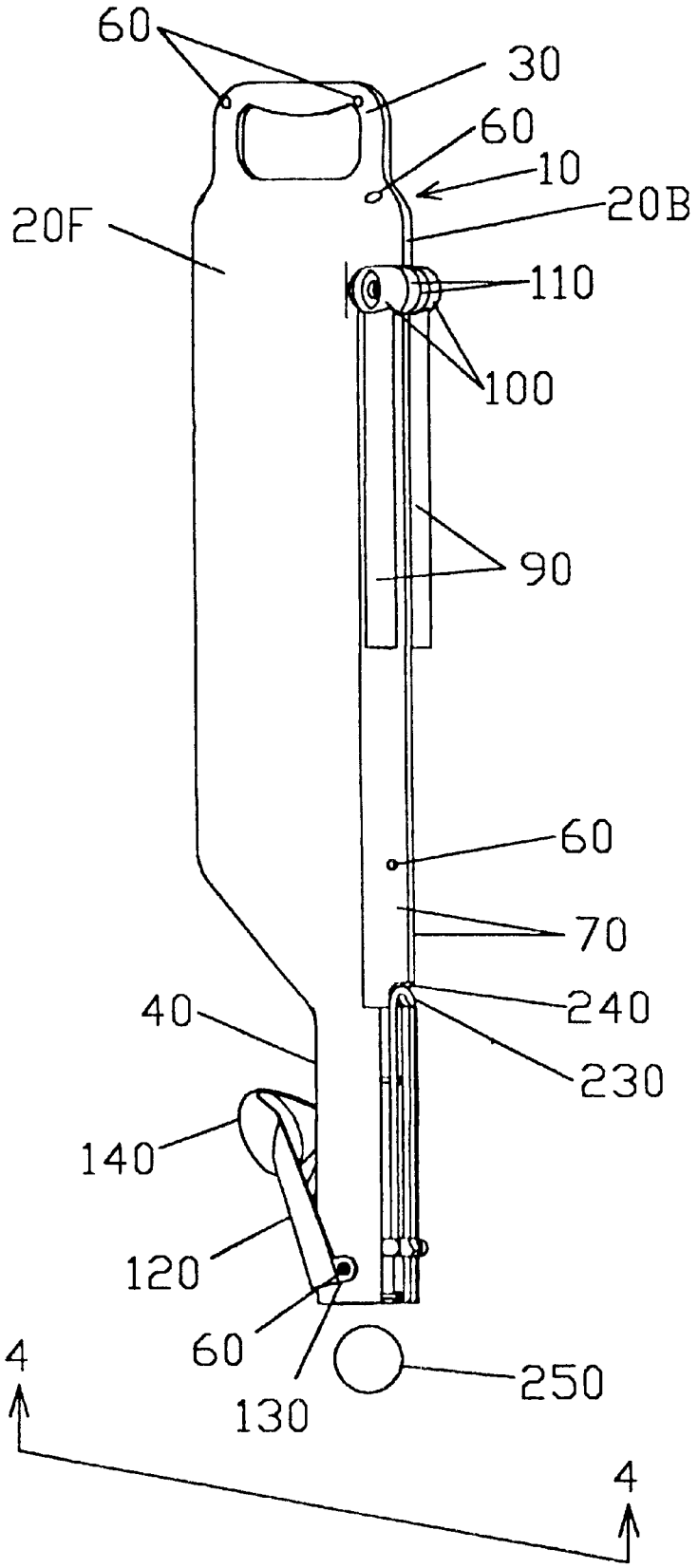
FIG. 1 is a perspective view of the present invention in an upright orientation.

FIG. 1 shows a side perspective view of one embodiment of the present invention, a ball handler 10, shown in a ball pickup orientation (perpendicular to the playing surface). The ball handler consists of several main parts including a hollow body comprising a front panel 20F and a back panel 20B, a neck 40 and a handle 30 that are both integrally formed as part of the front and back panels, legs 90 formed integrally with leg mounts 100, a lever 120, and a ball guide 230.

Front panel 20F and back panel 20B are preferably made from an injection molded polymer material such as nylon, polypropylene or other relatively strong plastic material. Preferably, both the front and back panels are shell structures with their perimeters curved toward the opposing panel as shown assembled together in FIG. 1, although many other configurations will work. The panels are essentially mirror images of each other and are designed to mate together to form the assembly shown in the figure. Preferably, the panels are attached to each other using screws 60 around the outside perimeter of each of the panels spaced approximately 50 to 100 mm apart. One skilled in the art would know a variety of other attachment methods. The screws pass through holes in front panel 20F and self-tap into molded blind holes (not shown) in back panel 20B. The blind holes are sized to be slightly smaller than the thread diameter of the screws allowing screws 60 to self-tap into the blind holes.

At the top of the ball handler is handle 30. The handle is sized to allow an adult hand to curl and grip around the top vertical portion of the handle. Handle 30 is formed as an integral part of each of the front and back panels during the molding process. Preferably, the handle consists of a shell structure, similar to the front and back panels, with half of the handle extending from front panel 20F and the other mirrored half from back panel 20B. When the panels are assembled together, as shown in FIG. 1, the two handle halves form one continuous smooth handle 30, shown in the figure. One skilled in the art would know that other handle configurations are possible.

Toward the bottom end of ball handler 10, the front and back panels transition on one side inwardly to form a narrow hollow section referred to as neck 40, shown in FIG. 1. The neck 40 is formed as an integral part of the front and back panels similar to handle 30.

Figure 4:
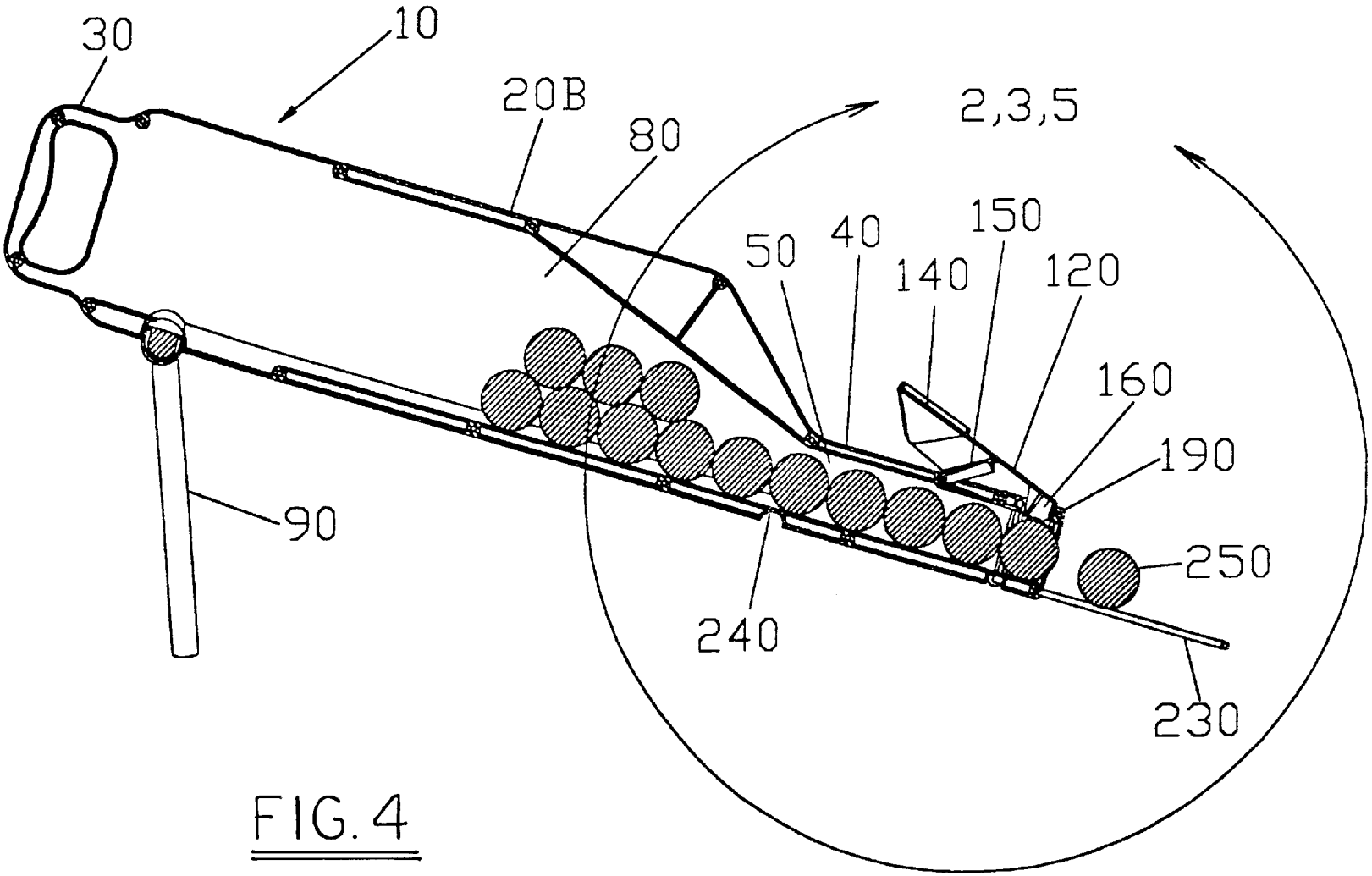
FIG. 4 is a full section view of the present invention.

When front panel 20F and back panel 20B are assembled together as shown in FIG. 1, they form a cavity 80 between them shown in FIG. 4. Cavity 80 between the two panels has a width that is preferably five to fifteen millimeters wider than the diameter of a ball 250 and has an overall volume large enough to store the desired number of the balls as can be seen in the section view in FIG. 4.

Figure 2:
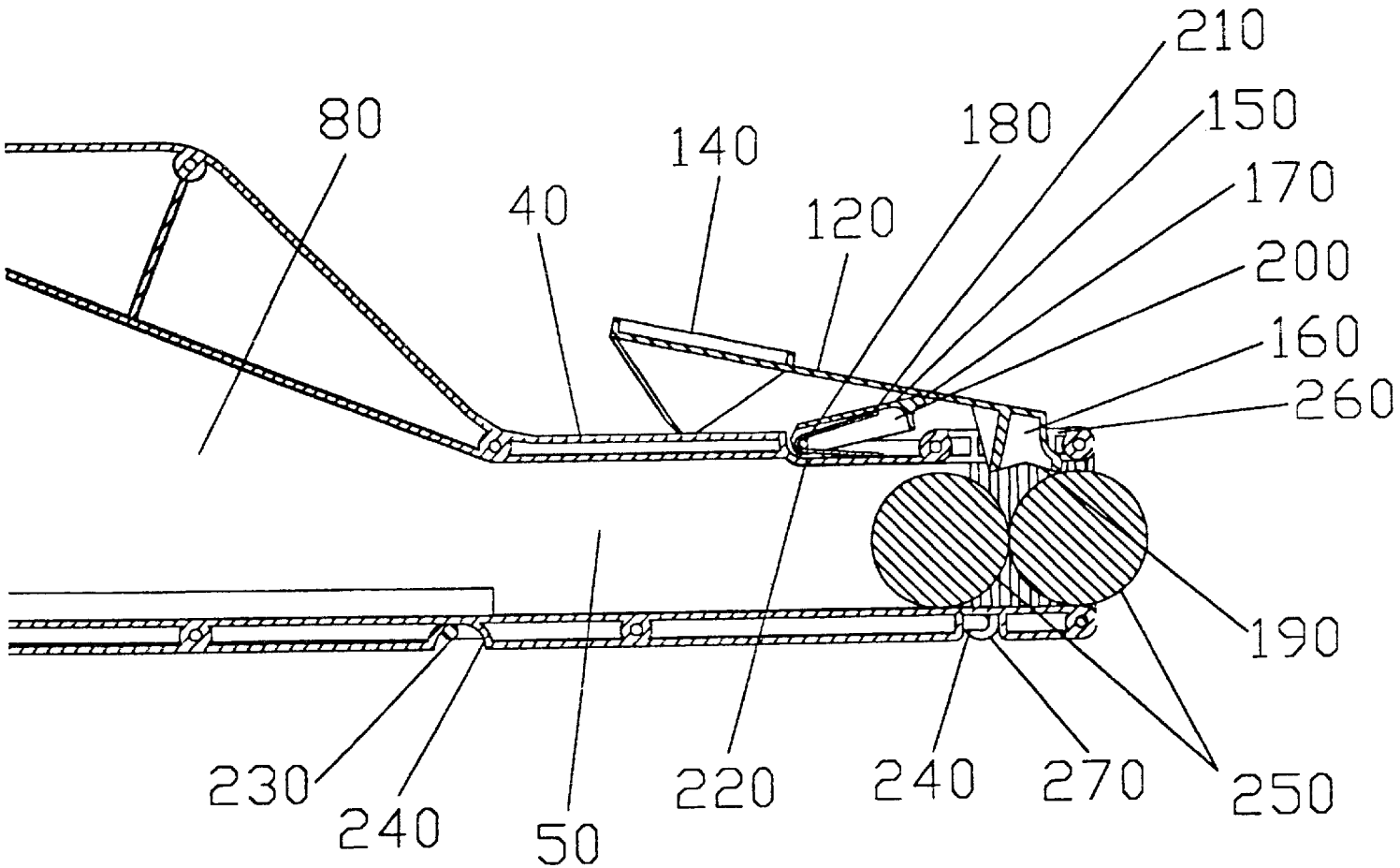
FIG. 2 is a partial section view of the tubular end of the present invention.

Referring now to FIG. 2, a partial section view, neck 40 has an open passage 50 between the front and back panels along the length of the neck. The passage is preferably five to fifteen millimeters wider and taller than the diameter of ball 250. Half of the passage is formed in front panel 20F and the other half in back panel 20B. Passage 50 transitions into cavity 80 forming a continuous opening from the cavity through the length of neck 40 through the end of the ball handler.

Channels 70, shown in FIG. 1, are integrally formed into the outside wall of front panel 20F and back panel 20B. The channel in front panel 20F, seen in FIG. 1, is identical to channel 70 formed into back panel 20B. Each channel is large enough to allow leg 90 to be partially stored within the channel when the legs are folded up against the body as shown in FIG. 1.

Figure 6:
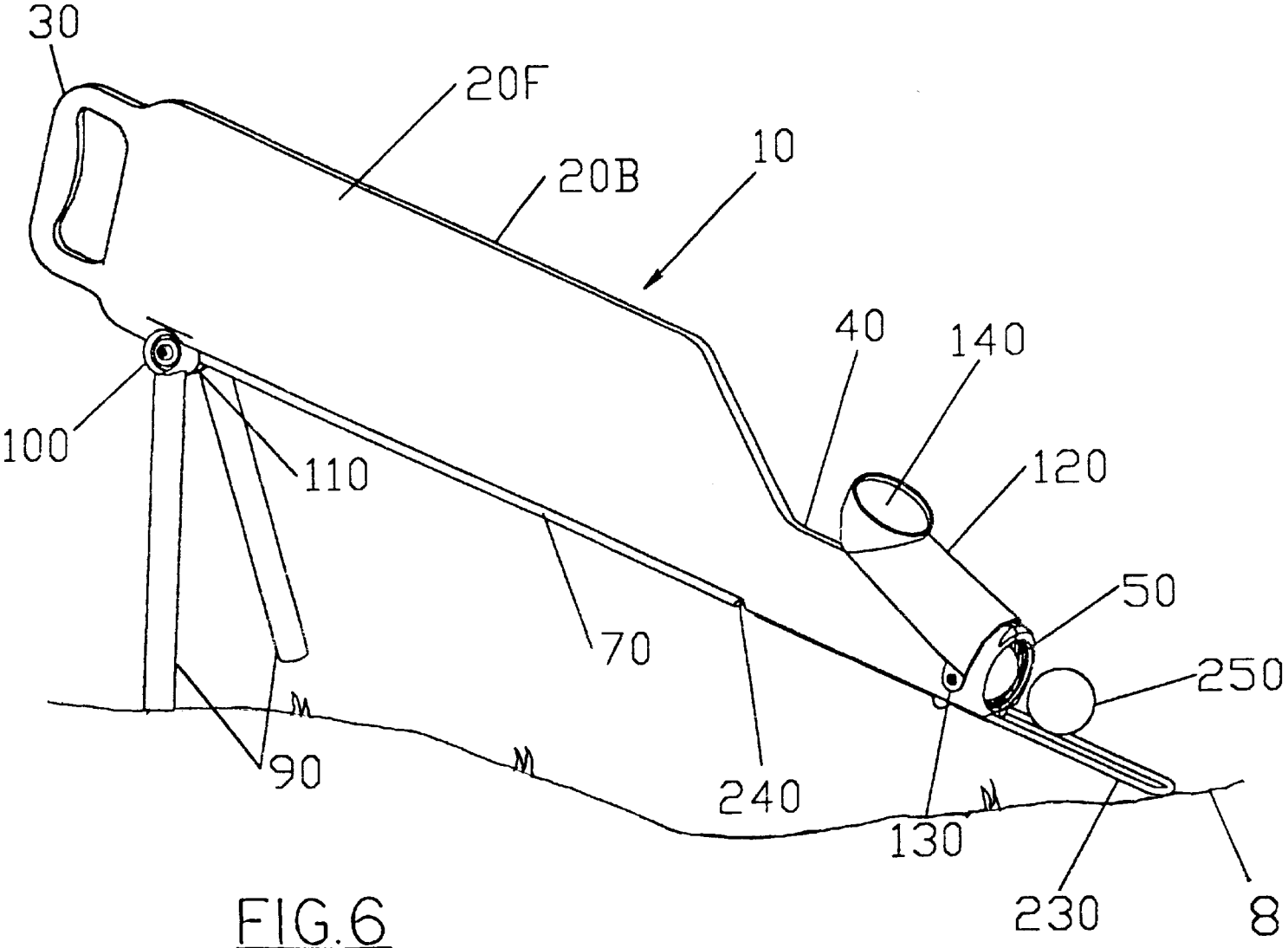
FIG. 6 is a perspective view of the present invention in a ball dispensing orientation.

A section view of the ball handler oriented to dispense balls 250 is shown in FIG. 4. The device forms an angle with respect to the playing surface 8 with the handle elevated off of the ground and guide 230 in contact with the playing surface 8. The ball handler 10 is thus supported on the playing surface 8 without damaging the playing surface. In this position, legs 90 are rotated away from the body with the free ends of the legs resting on the playing surface. Legs 90 are preferably made from a tubular molded plastic construction. As can be seen in FIG. 6, the legs are of sufficient length to cause ball handler 10 to have a fifteen to fifty degree angle of inclination relative to the playing surface 8 when the legs are extended away from the body. Legs 90 are integrally formed with leg mounts 100 as shown in FIGS. 1 and 6. Leg mounts 100 are pivotally attached to the front and back panels using screws 60 that extend through holes in the leg mounts and self-tap into blind holes in the front and back panels (not shown). The leg mounts and legs are preferably injection molded using nylon, polypropylene or another rigid plastic material. The leg mounts 100 are attached to angled mount surfaces 110 that protrude from the front and back panels. Mount surfaces 110 are an integral part of front and back panels 20F and 20B. The mount surfaces are shown in FIG. 1.

Figure 3:
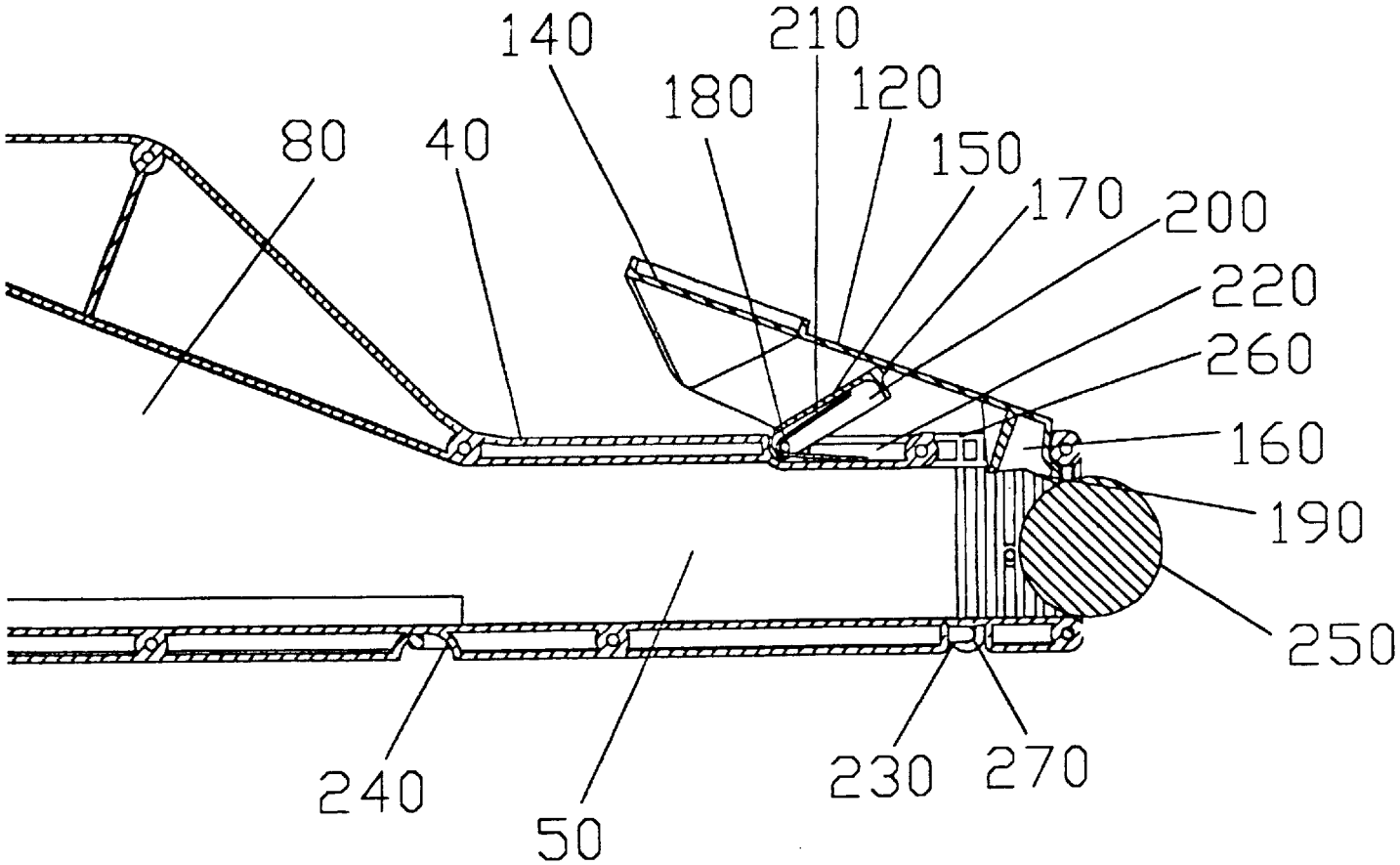
FIG. 3 is a partial section view of the tubular end of the present invention.

Lever 120, shown in FIG. 1 and in the section view of FIG. 3, is preferably made from an injection molded plastic such as nylon, polypropylene or other rigid polymer material. Preferably the lever 120 has a U-shape cross section enabling it to partially cover neck 40 when the lever 120 is depressed as shown in FIG. 2. Other lever configurations will work equally well. Lever 120 has two tabs 130 that extend as a continuation of the main body of the lever that partially surround the outside of neck 40. FIG. 1 shows one of these tabs. Each of the tabs has a hole going through the thickness of the lever. Lever 120 is preferably attached to the front and back panels by screws 60. The screws extend through the holes in the tabs on the lever that align with holes in the front and back panels that have a diameter less than the diameter of the threads on the screws. Therefore, as the screws are rotated into these holes they self-tap into the front and back panels during assembly. The screws provide attachment points that lever 120 can pivot about. The lever can pivot between a depressed position, shown in FIG. 2 and a normal position, shown in FIG. 3. As shown in FIG. 6, lever 120 preferably includes a cupped surface 140 that is formed as an integral part of the lever during the molding process. The lever has sufficient length to provide a significant mechanical advantage causing the lever to rotate about the attachment screws when a force acting to depress the lever against neck 40 is applied to cupped surface 140.

Figure 5:
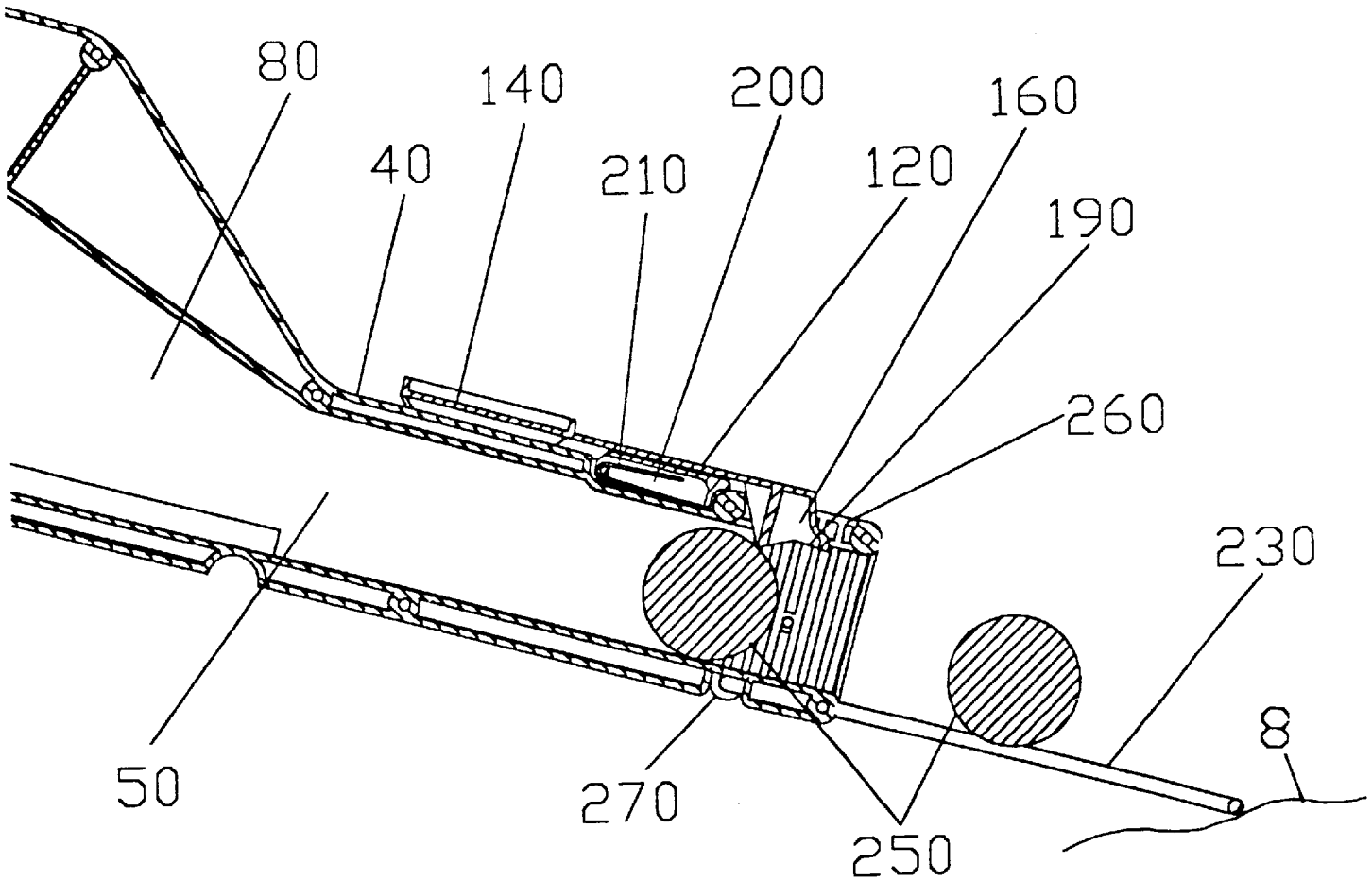
FIG. 5 is a partial section view of the tubular end of the present invention.

As shown in FIG. 3, a stop 160 extends from the underside concave surface of lever 120. In the preferred embodiment of the present invention the lever 120 and the stop 160 are formed as one continuous molded plastic part. The stop extends through an opening 260 in the wall of passage 50. The stop 160 is preferably 2 to 10 mm wide and extends through the opening regardless of the position of lever 120. Opening 260 is formed from cutouts in front panel 20F and back panel 20B. Stop 160 has a 5 to 20 mm long upside down V-shaped contact surface 190, as shown in FIG. 3. When lever 120 is in the normal position, as shown: in FIG. 3, the right side of contact surface 190 is designed so that ball 250 can be trapped to the left of this portion of the contact surface. When the lever is depressed as shown in FIG. 5, ball 250 is free to pass under the right portion of the V-shaped contact surface but a second ball 250 cannot pass by the left portion of the V-shaped contact surface. This is due to the right portion of the stop lifting up when lever 120 is depressed. At the same time, the left portion of the contact surface moves further into passage 50 preventing the ball 250 that is located left of stop 160 from exiting with the first ball 250 as shown in FIG. 5.

As shown in FIGS. 3 and 4, a member 150 extends between the underside of lever 120 and the end of a groove 220. The member is generally a rectangular shape shell structure with 1 to 2 mm thick walls forming a spring pocket 200 on the underside of the member. Member 150 has a relatively large outer radius 170 at one end that is in contact with the underside of lever 120 and a cylindrical hole (not shown) in the opposite end. A cylindrical pin 180 extends through the holes in the sidewalls of member 150. The pin 180 is preferably made from steel or a rigid plastic such as nylon or polypropylene. The ends of the pin 180 are inserted into holes in the front and back panels that have a diameter slightly larger than the diameter of the pin 180. This allows member 150 to pivot about the center of the pin 180. Therefore, the member is pivotally attached to the front 20F and back 20B panels. Member 150 is preferably made from a molded rigid polymer such as nylon, polypropylene, or other rigid material. Spring pocket 200, shown in FIG. 3, is integrally formed as part of member 150. The spring pocket 200 is sized to allow one end of a spring 210 to seat in the spring pocket 200.

As shown in FIG. 3, a groove 220 is located in the outside surface of the top of neck 40 and is centered between the front and back panels. Half of the groove is integrally formed into front panel 20F and the other half into back panel 20B. The groove is a rectangular shape cutout formed into the top of the neck that is preferably between 2 to 10 mm deep. The groove is sized to allow one end of spring 210 to seat in the groove.

As shown in FIG. 3, spring 210 is located between spring pocket 200 in member 150 and groove 220 on neck 40. The spring is preferably a steel wire torsion spring with two straight ends, although other biasing means such as leaf springs or other springs will work. The spring is slightly compressed during the process of assembling the ball handler and is held in that position by trapping the ends of spring 210 within spring pocket 200 and groove 220 as shown in FIG. 3. Therefore, the spring is positioned so that the ends of spring 210 contacts the bottom of groove 220 on one end of the spring and the underside of member 150 on the opposing end. The spring is preferably made from steel wire that has a diameter between 0.75 and 1.2 mm.

Guide 230, shown in FIGS. 4, 5 and 6, is preferably made from metal wire that has a diameter between 4 and 7 mm. Other guide configurations, such as a solid flat or concave guide could also be used. The ends of the wire guide are bent outwardly away from each other and extend through guide holes 270 in front panel 20F and back panel 20B forming a pivotal attachment of the guide to the front and back panels. Because the guide 230 is made from bent steel wire it has a spring characteristic that allows the ends to be pinched inwardly toward each other causing the ends to move closer together. Once the inwardly pinched ends of guide 230 are positioned in front of guide holes 270 in the front and back panels, the pinching force is removed to allow the ends of the guide to spring into the guide holes, thus providing the attachment method. The attachment of the guide to the back panel is shown in FIG. 3. The end of guide 230 is shown inserted in guide hole 270 in the back panel. Guide 230 can be rotated relative to the front and back panels because the ends of the guide can rotate within guide holes 270. Therefore, the guide 230 can be stored out of the way against the ball handler as shown in FIGS. 1, 2 and 3 or extended for use as shown in FIG. 6. The guide is held tight to the front and back panels as shown in FIG. 1 by pushing the guide against the bottom of neck 40. The friction between guide holes 270 and the ends of guide 230 prevents the guide from moving freely. The rounded middle section of the guide fits into a slot 240 formed into the bottom of the front and rear panels when the guide is in the stored position, shown in FIG. 3.

Operation of Invention

The function of the individual components of ball handler 10 will now be described in detail.

As shown in FIG. 1, front and back panels 20F and 20B, respectively, make up the structural body of the ball handler and are used to store balls within cavity 80, shown in FIG. 4, and attach the other components making up the device. At the top of front panel 20F is half of handle 30 that is a continuous part of the panel, the other half of the handle is formed from back panel 20B. Handle 30 is made complete when the front and back panels are assembled together because half of the handle is formed from each panel. Handle 30 is sized to allow an adult hand to comfortably grip the handle with the fingers wrapping around the top portion of the handle. This allows the user to grip the ball handler with one hand and use it to retrieve balls in the upright position, shown in FIG. 1.

As shown in FIG. 1, toward the bottom of the front and back panels the wide body transitions on one side inwardly toward the center to form a narrow section of the body called neck 40. This area is designed to allow the balls to easily transition from a group of balls 250 down to a single row of the balls in passage 50 of the neck area as shown in FIG. 4.

The gradual change in ball organization helps avoid ball jams when the balls 250 move from cavity 80 through passage 50 and exit ball handler 10. Neck 40 also provides an area for lever 120 to rotate down over when force is applied to the lever to depress it against the neck 40. The neck 40 is the structural body making up passage 50. The passage provides balls access from outside the ball handler to within cavity 80. Passage 50 is sized so that balls 250 can only be ordered in a single row as shown in FIG. 4. Cavity 80 provides an enlarged area to facilitate storing of a plurality of the balls in a random group arrangement.

As shown in FIG. 1, channels 70 provide a storage area for legs 90 to be stored when the legs are not in use. At the top of the each channel is mount surface 110. These mount surfaces are on angles with respect to the front and back panels to cause legs 90 to rotate away from the body forming a wide stance as shown in FIG. 6. The legs 90 offer structural support to elevate the top of the ball handler with respect to the playing surface 8. The leg mounts are formed as an integral part of the legs and provide a strong attachment area for attaching the legs to the front and back panels.

As shown in FIGS. 1 and 4, lever 120 is sufficiently long enough to provide a significant mechanical advantage to depress the lever 120 and compress spring 210. Cupped surface 140 of the lever provides a target area that can be depressed by the user pushing down on the cupped surface with the head of a golf club. The downward force applied by the golfclub head moves the cupped surface 140 of the lever 120 down, rotating lever 120 around screws 60 in tabs 130. The shape of cupped surface 140 assists the user in keeping the head of the club on the lever 120 while the user pushes the lever 120 down. The U-shaped cross section of lever 120 provides good structural strength for the lever 120 and allows it to partially cover neck 40 when it is depressed as shown in FIG. 2. The lever has two tabs 130 that provide attachment points for attaching the lever to the front and back panels, one of the tabs is shown in FIG. 1. The tabs have holes that are used to attach the lever to the front and back panels using screws 60 that extend through the holes. Therefore, the lever can be rotated around the holes to enable it to be depressed and released as shown in FIGS. 2 and 3, respectively.

As shown in FIGS. 2 and 3, stop 160 extends from the underside of lever 120. The stop 160 extends into passage 50 and serves to control the passage of balls 250 from exiting the passage. The stop 160 is positioned on the bottom of lever 120 so that when the lever is depressed and, therefore, rotates around screws 60 in tabs 130 the right side of the stop retracts upward and the left side of the stop protrudes deeper into passage 50. The left side of stop 160 is used to stop two balls from exiting at once when lever 120 is depressed and the ball handler is in a ball dispense position as shown in FIG. 5. The right side of the stop is used to prevent stored balls 250 from rolling out of the passage when the lever is not depressed as shown in FIG. 4. When the user retrieves balls 250 from the playing surface, the ball entering passage 50 contacts the right side of stop 160 first as shown in FIG. 3. If the user forces the ball handler downwardly, the ball is forced up into passage 50 causing lever 120 to rotate around screws 60 in the tabs, raising the right side of the stop and allowing the ball past. The left side of stop 160 is designed to avoid contacting the entering ball if another ball 250 forces the first ball retrieved beyond the left side of the stop. With lever 120 in the normal position, shown in FIG. 3, the right side of the stop extends further into the passage than the left side of the stop.

As shown in FIG. 3, member 150 is located under lever 120. Member 150 has spring pocket 200 that contains one end of spring 210. The member provides a method of trapping spring 210 between groove 220 and spring pocket 200 and provides a stiff mechanical structure to transmit the force applied to it by the spring onto the underside of lever 120 as shown in FIG. 3. The member has a large radius 170 that provides a smooth surface to slide along the underside of lever 120 when the lever is depressed or released. On the opposite end of radius 170 are two holes (not shown) in the sides of member 150. Pin 180 is inserted through the holes in member 150 during the assembly process and provides a pivotal attachment of member 150 to the front and back panels. The pin is also inserted through he center hole in spring 210 to trap the spring in its position between pocket 200 and groove 220. Therefore, radius 170 remains in constant contact with the underside of lever 120 due to the force applied to it by spring 210. The radius slides up and down the surface of the lever as member 150 rotates about pin 180.

As shown in FIG. 3, groove 220 formed into the top of neck 40 provides a recessed area that spring 210 can be captured between the groove and spring pocket 200 in member 150. The sidewalls of groove 220 prevent the spring from escaping and the bottom surface of the groove provides a structural support surface that the spring can exert force upon.

As shown in FIG. 3, spring 210 is compressed slightly during the assembly of the ball handier 10 to provide the desired amount of spring force to resist counterclockwise rotation of lever 120. The spring applies force on the bottom of groove 220 and the top of spring pocket 200, resulting in radius 170 of member 150 applying a contact force upon the underside of lever 120. As shown in FIG. 4, balls 250 stored in cavity 80 apply pressure to the balls in passage 50 when the ball handler is positioned so that the opening of passage 50 is pointing downward. The ball pressure exerts a force on the right side of contact surface 190 that tends to rotate the lever around screws 60 in tabs 130 in a counterclockwise direction. Spring 210 is used, as previously described, to resists this unwanted counterclockwise rotation to keep the lever normally in the normal position as shown in FIG. 4, preventing balls 250 in cavity 80 and passage 50 from exiting the ball handler.

As shown in FIG. 6, wire guide 230 is designed to provide ball 250 with guidance when the ball is dispensed out of passage 50. The ball rolls between the two wires of the guide toward the playing surface. The wires on the guide are spaced approximately 10 to 20 mm apart. This allows the ball to partially sink between the wires of the guide when it rolls down the guide in a controlled manner. The rounded end of the guide rests on top of the playing surface, elevating the opening of passage 50. This allows balls 250 to roll out of the opening in passage 50 without being obstructed by tall grass or other objects on the playing surface. The length of the wire guide is approximately three to ten times the diameter of ball 250 to allow the ball to gain enough speed while rolling down the slide to help the ball roll away from the guide once it contacts the playing surface.

The manner in which the present invention, ball handler 10, is used will now be discussed in detail. The ball handler has three primary functions. They are to retrieve balls 250 from the playing surface, store the balls within cavity 80 and passage 50 and dispense the balls through passage 50 when the player depresses lever 120. This is accomplished without having to change any components of the ball handler. The neck 40, passage 50 and stop 160 are designed such that the balls 250 may enter and exit using the same components.

FIG. 1 shows the ball handler in an upright position that is required to retrieve balls from the playing surface. To retrieve a ball the user grips handle 30 with one hand and positions the opening of passage 50 over the ball. Once the passage opening is aligned over the ball to be retrieved, the user lowers ball handler 10 down so that the ball begins to enter passage 50 until it contacts the right lower corner of stop 160 as shown in FIG. 3. Next, the user applies a downward force with the hand that is gripping handle 30 to force ball 250 to apply a contact force on the lower right corner of stop 160. When the contact force applied by the ball on the stop's corner exceeds the resistance of the lever to rotate counterclockwise around screws 60 in tabs 130, the lever rotates and the lower right corner of the stop moves upward as shown in FIG. 2. As the lever rotates downward over neck 40, radius 170 of member 150 slides downward along the underside of the lever. The movement of lever 120 downward causes spring 210 to compress into a tighter coil shape because it is trapped between the top of the spring pocket 200 and the bottom surface of groove 220. Therefore, the stop is used to transmit contact force from the ball to the lever causing the lever to rotate counterclockwise due to ball 250 forcing the bottom of stop 160 upward allowing ball 250 to enter further into passage 50.

When the center of ball 250 moves past the right corner of stop 160, contact surface 190 begins to assist in moving ball 250 further into passage 50. This is due to the force applied by spring 210 on the underside of member 150 within spring pocket 200 creating a moment force on lever 120 about screws 60 in tabs 130. This moment force causes lever 120 to rotate clockwise forcing the right side of stop 160 downward, further into passage 50 moving the ball deeper into passage 50. This action occurs until lever 120 has returned to the fully sprung outward position, shown in FIG. 4.

When the lever is in the normal position, shown in FIG. 4, the ball is trapped behind the right portion of contact surface 190. Spring 210 creates a moment force about screws 60 in tabs 130 on lever 120 causing it to resists counterclockwise rotation. This prevents balls 250 on the left side of the stop from exiting back out of passage 50 in the opposite direction that they entered. Therefore, the balls that have been retrieved and are shown on the left side of stop 160 are trapped in passage 50, as shown in FIG. 4, by the right side of contact surface 190. Spring 210 prevents lever 120 from rotating counterclockwise to allow the balls on the left of the stop to exit out of passage 50 unless lever 120 is depressed as shown in FIG. 2.

As shown in FIG. 4, cavity 80 is partially filled with balls 250 by repeating the retrieving procedure for a plurality of balls 250 until some or the entire cavity is filled with the balls. Spring 210 applies a constant force on member 150 to keep it in contact with lever 120, creating a clockwise rotational moment force on the lever about screws 60 in tabs 130. The resistance of the lever to rotate counterclockwise prevents balls 250 from exiting past the right portion of stop 160. Therefore, the ball handler can store a plurality of balls 250 within cavity 80 and passage 50, shown in FIG. 4, without the balls rolling out of passage 50.

If the player desires, the ball handler can be transported with a plurality of balls stored within cavity 80 simply and easily by gripping handle 30 and picking the ball handler up. Legs 90 can be folded and stored in channels 70. The legs are kept in position by the friction between leg mounts 100 and mount surfaces 110, shown in FIG. 1. Guide 230 can be folded by hand against the side of the front and back panels. The guide is held in position by the friction between the ends of the wire guide and the guide holes.

As shown in FIG. 5, a partial section view, the ball handler can also be easily used to dispense golf balls one at a time out of passage 50 by depressing lever 120. This is accomplished by the user positioning ball handler 10 with the opening of passage 50 facing downward with the free end of the legs extended away from the front and back panels, resting on the playing surface 8 as shown in FIG. 6. The wire guide is rotated away from the front and back panels with the round end of the guide resting on the playing surface 8, also shown in FIG. 6. The user stands near the passage opening and depresses lever 120 so that the lever rotates counterclockwise around screws 60 in tabs 130 as shown in FIG. 5. Lever 120 can be depressed in this manner using the users hand or other object such as the end of a typical golf club. When lever 120 is substantially depressed as shown in FIG. 5, spring 210 is compressed into a tighter coil shape and the right side of contact surface 190 on stop 160 moves upward allowing the front ball 250 to travel downward past stop 160 and out of passage 50. At the same time, the left side of stop 160 moves downward contacting the rear ball that was behind the front ball that was released preventing it from exiting with the released ball as shown in FIG. 5. Therefore, the released ball is allowed to exit and the ball on the left that was behind the released ball is prevented from exiting because it comes in contact with the left side of stop 160. Once the released ball 250 exits passage 50 it rolls onto guide 230. The opening between the two wire guides is less than the diameter of a typical golf ball and serves to direct the rolling ball toward the playing surface as shown in FIG. 5.

When lever 120 is released, spring 210 forces the lever to rotate clockwise so that the left side of stop 160 moves upward allowing the ball that was in contact with the left side of the stop to roll forward until it contacts the right side of contact surface 190, as shown in FIG. 4. In the normal position, shown in FIG. 4, spring 210 applies enough force to the underside of lever 120 creating a clockwise moment on lever 120 that prevents balls 250 from exiting past the right side of contact surface 190. Therefore, the balls are kept in passage 50 by the contact between the right side of the contact surface and the front ball, as can be seen in FIG. 4.

Accordingly, the one skilled in the art will recognize that the ball handler device of this invention can be used for practicing and other golf activities easily and conveniently, can be transported just as easily using one hand and can store golf balls. Furthermore, this invention has the additional advantages in that (a) it provides a ball handler that is inexpensive to manufacture by making it from simply manufactured parts that are easily assembled;

(b) it provides a ball handler that will store a plurality of golf balls in an attractive product;

(c) it provides a ball handler that will allow the user to dispense the balls one at a time;

(d) it provides a ball handler that can be used to retrieve balls off of and dispense balls to a golf course putting green without damaging the surface of the green; and (e) it provides a ball handler that is robust and durable by protecting the ball control device within its tubular end;

Although the description above contains many specificities, these should not be construed as limiting the scope of the invention but as merely providing illustrations of some of the presently preferred embodiments of this invention. For example, the two injection molded body panels could be replaced by one blow-molded body; the screws holding the body panels together could be replaced with snap features; the body panels could be wider or have a different shape allowing more or less ball storage; the body could be replaced with a round cross section body; the two plastic legs could be replaced with metal legs or one wire formed stand; the wire ball guide could be replaced by a plastic guide or slide; and the lever could be made from metal, etc.

Thus the scope of the invention should be determined by the appended claims and their legal equivalents, rather than by the examples given.

What is claimed is:

1. An apparatus for retrieving and dispensing golf balls on a playing surface, comprising:

a body having a top end and a bottom end, said bottom end has an opening formed to allow passage of golf balls therethrough;

a ball control means attached to said body near said opening to control ball entrance into and exit from said body wherein said ball control means is contained between said top end and said bottom end of said body;

means for pivotally attaching said ball control means to said body, said ball control means being movable between a closed position wherein golf balls are prevented from passing through said opening of said body, and an open position wherein golf balls are permitted to pass through said opening of said body, wherein said ball control means comprises:

a lever;

a stop located within said body and connected to said lever for obstructing said opening in said bottom end, said stop having a first portion and a second portion;

biasing means associated with said lever for biasing said stop to said closed position, such that movement of said lever causes said stop to move to said open position to release a golf ball through said opening of said body, such that a single golf ball is released with each movement of said lever and said second portion of said stop means prevents a second golf ball from being released.

2. The apparatus of claim 1 further comprising a handle attached to said body.

3. The apparatus of claim 2 wherein said handle is formed as an integral part of said body.

4. The apparatus of claim 1 further comprising means for supporting said top end of said body at a position higher than said bottom end to cause golf balls stored within said body to roll through said opening when said stop is in said open position.

5. The apparatus of claim 4 wherein said means for supporting said top end of said body includes at least one elongated support member pivotally attached to said body.

6. The apparatus of claim 1 further comprising a ball guide attached to said body for guiding a golf ball from said opening to the playing surface.

7. The apparatus of claim 6 wherein said ball guide is a formed wire.

8. The apparatus of claim 1 wherein said body includes two separate panels attached together.

9. The apparatus of claim 1 wherein said hollow body is a blow-molded plastic body.

10. The apparatus of claim 1 wherein said means to attach said ball control means to said body is at least one fastener.

11. The apparatus of claim 1 wherein said stop and said lever are formed as one integral part.

12. The apparatus of claim 1 wherein said biasing means is a spring.

13. The apparatus of claim 12 wherein said spring is a coil spring.

14. An apparatus for retrieving and dispensing golf balls on a playing surface, comprising:

a body having a top end and a bottom end, said bottom end has an opening formed to allow passage of golf balls therethrough;

a ball control means pivotally attached to said body near said opening to control ball entrance into and exit from said body wherein said ball control means does not protrude beyond said bottom end of said body, said ball control means being movable between a closed position wherein golf balls are prevented from passing through said opening of said body, and an open position wherein golf balls are permitted to pass through said opening of said body, wherein said ball control means comprises:

a member;

a stop located within said body for obstructing said opening in said bottom end, wherein said stop is connected to said member, said stop having a first portion and a second portion;

a bias means associated with said member for biasing said stop to said closed position, said member having an end which can be pressed to move said stop to said open position to allow a golf ball to be released from said opening of said body, such that a single golf ball is released with each movement of said member and said second portion of said stop means prevents a second golf ball from being released.

15. The apparatus of claim 14 further comprising a handle attached to said body.

16. The apparatus of claim 14 further comprising a means for supporting said top end of said body above said bottom end of said body to cause golf balls stored within said body to roll through said opening when said stop is in said open position.

17. The apparatus of claim 16 wherein said means for supporting said top end of said body includes at least one elongated support member pivotally attached to said body.

18. The apparatus of claim 14 further comprising a ball guide means attached to said body for guiding a golf ball from said opening to the playing surface.

19. The apparatus of claim 18 wherein said ball guide means is a formed wire.

20. The apparatus of claim 14 wherein said member is a lever.

21. An apparatus for retrieving and dispensing golf balls on a playing surface, comprising:

a body having a top end and a bottom end, said top end and said bottom end aligned substantially along a longitudinal axis of said body, said bottom end has an opening formed at one end of said longitudinal axis to allow passage of golf balls therethrough;

a ball control means attached to said body near said opening to control ball entrance into and exit from said body wherein said ball control means is contained between said top end and said bottom end of said body;

means for pivotally attaching said ball control means to said body, said ball control means being movable between a closed position wherein golf balls are prevented from passing through said opening of said body, and an open position wherein golf balls are permitted to pass through said opening of said body, wherein said ball control means comprises:

a lever;

a stop located within said body and connected to said lever for obstructing said opening in said bottom end, said stop having a first portion and a second portion;

biasing means associated with said lever for biasing said stop to said closed position, such that movement of said lever causes said stop to move to said open position to release a golf ball through said opening of said body, such that a single golf ball is released with each movement of said lever and said second portion of said stop means prevents a second golf ball from being released.

* * * * *